United States Patent [19]

Parker et al.

[11] 4,003,317

[45] Jan. 18, 1977

[54] RESILIENTLY CENTERED RAILWAY TRUCK SUSPENSION

[76] Inventors: John Henry Parker, 730 St. Aubin, St. Laurent, Quebec; Frank Thomas McInerney, 190 de Normandie, St. Bruno, Quebec, both of Canada

[22] Filed: Feb. 27, 1974

[21] Appl. No.: 446,393

Related U.S. Application Data

[63] Continuation-in-part of Ser. No. 269,549, July 7, 1972, abandoned.

[52] U.S. Cl. ..... 105/184; 105/136; 105/175 A; 105/195; 105/199 R

[51] Int. Cl.[2] ..... B61F 1/14; B61F 3/06; B61F 5/20; B61F 5/24

[58] Field of Search ..... 105/4 R, 75, 157 R, 105/181, 183, 188, 195, 196, 199 C, 136, 182 R, 199 R, 175 A, 184, 195

[56] References Cited

UNITED STATES PATENTS

| | | | |
|---|---|---|---|
| 975,303 | 11/1910 | Vauclain | 105/75 |
| 2,150,116 | 3/1939 | Farr | 105/4 R |
| 2,954,747 | 10/1960 | Hirst et al. | 105/196 |
| 3,212,456 | 10/1965 | Dilworth et al. | 105/196 |
| 3,257,969 | 6/1966 | Thomas | 105/199 C |
| 3,361,085 | 1/1968 | Bexon et al. | 105/196 |
| 3,447,483 | 6/1969 | Lich | 105/196 X |
| 3,451,355 | 6/1969 | Dobson et al. | 105/196 X |
| 3,451,356 | 6/1969 | Lich | 105/196 X |
| 3,738,283 | 6/1973 | Burgess | 105/196 |

FOREIGN PATENTS OR APPLICATIONS

| | | | |
|---|---|---|---|
| 929,798 | 7/1973 | Canada | 105/196 |

*Primary Examiner*—Robert J. Spar
*Assistant Examiner*—Howard Beltran

[57] ABSTRACT

A secondary suspension for use on a railway three-axle truck frame. Each of the three axles are equidistantly spaced from one another and driven by a respective traction motor mounted on bearings on each axle and additionally supported by the truck frame. The truck also has a suitable traction load connection for attachment to a locomotive chassis. The secondary suspension comprises three laminated metal and rubber pads positioned between the upper surface of the truck frame and the locomotive chassis. Two of the pads are positioned forwardly of the central axle of the three axles, and to a respective side of the central longitudinal axis of the truck frame. The other pad is positioned on the central longitudinal axis rearwardly of the central axle. The spacing of the pads, relative to the central axle, is predetermined whereby the resultant force of the chassis load is applied forwardly of the central axle with all three pads being equally loaded by the chassis whereby this resultant force will balance the resultant force of the truck sprung masses which is rearwardly of the central axle thereby giving a net resultant rail force substantially at the central axle.

1 Claim, 2 Drawing Figures

RESILIENTLY CENTERED RAILWAY TRUCK SUSPENSION

This application is a continuation-in-part application of application Ser. No. 269,549, filed July 7, 1972 and abandoned in favour of this application.

BACKGROUND OF INVENTION

1. Field of the Invention

The present invention relates to a secondary suspension for railway vehicle three-axle trucks and more particularly to an improved secondary suspension utilizing laminated pads.

2. Description of the Prior Art

The secondary suspension of a railway truck is a spring system that divides the truck mass from the chassis mass. It is possible to utilize secondary springs that will also accommodate the necessary truck rotation relative to the chassis and lateral motion of the truck relative to the chassis. Such a system for a three axle truck is described in U.S. Pat. No. 3,451,355, to Dobson et al, which uses four laminated rubber-and-metal elements, such as made by Metalastik of Leicester, England, and others. Rubber-and-metal laminated elements are used in a similar fashion in applicants' Canadian Patent 929,798 entitled "Two-Axle Truck Assembly."

In the Dobson et al patent it is noted that the two inboard pads take approximately one-sixth of the chassis load, whilst the two outboard pads one-third of the chassis load. Therefore, if the two inboard pads were added together to take one-third of the load, then obviously one single pad identical to the outboard pads would suffice. Therefore, by positioning a single inboard pad centrally and aligned between the two outboard pads, the two inboard pads are eliminated. A three-pad arrangement versus the four-pad arrangement gives substantially the same stability of truck relative to chassis for lateral leaning and in the fore and aft stability of the truck.

The three-pad arrangement of the present invention is designed to give better flange forces, i.e. lower flange forces, because of the torsional restoring rate of the rubber suspension in the following manner: The rubber pads, when loaded in the perpendicular direction, lose shear stiffness as the load is increased; therefore, two pads operating at, say, 20% of their ultimate capacity will have a given shear stiffness which the truck must work against to rotate when negotiating a curve. However, the same pad when loaded to 40% of its ultimate capacity will have a substantially lower shear stiffness than at 20%. Further, one pad loaded to 40%, already lower than one pad loaded to 20%, is obviously 50% fewer pads. In other words, a twofold reduction is achieved, (1) a decrease in the shear stiffness by increasing load on a pad and (2) decreasing the number of pads to be sheared.

It is known from theoretical analysis and from the system described in the above-mentioned patent, that the shear rates of the rubber-and-metal pads which act to align the truck with the chassis contribute adversely to flange loading as the locomotive negotiates curves; and further that the same torsional restoring rate (summation of all shear rates times radius) contributes to dynamic instability on straight track.

It is also known from theoretical analysis that a very low torsional rate is necessary when the locomotive trucks are equipped with an inter-bogie control device, a device or arrangement well known in the art for controlling truck alignment and flange forces when negotiating curves.

SUMMARY OF INVENTION

It is a feature of the present invention to reduce the number of laminated pads in a secondary suspension to three, and further, to use a pad of a shape that, when the vertical load is applied, has substantially zero shear rate horizontally in all directions.

Accordingly, from a broad aspect, the present invention provides a secondary suspension for use on a railway three-axle truck frame. Each of the three axles are equidistantly spaced from one another and driven by a respective traction motor mounted on bearings on each axle and additionally supported by the truck frame. The truck also has a suitable traction load connection for attachment to a locomotive chassis. The secondary suspension comprises three laminated metal-and-rubber pads positioned between the upper surface of the truck frame and the locomotive chassis. Two of the pads are positioned forwardly of the central axle of the three axles, and to a respective side of the central longitudinal axis of the truck frame. The other pad is positioned on the central longitudinal axis rearwardly of the central axle. The spacing of the pads, relative to the central axle, is predetermined whereby the resultant force of the chassis load is applied forwardly of the central axle with all three pads being substantially equally loaded by the chassis whereby this resultant force will balance the resultant force of the truck sprung masses which is rearwardly of the central axle thereby giving a net resultant rail force substantially at the central axle.

BRIEF DESCRIPTION OF DRAWINGS

The preferred embodiment of the present invention will now be described with reference to the accompanying drawings in which.

DESCRIPTION OF PREFERRED EMBODIMENTS

Figures 1, 2:
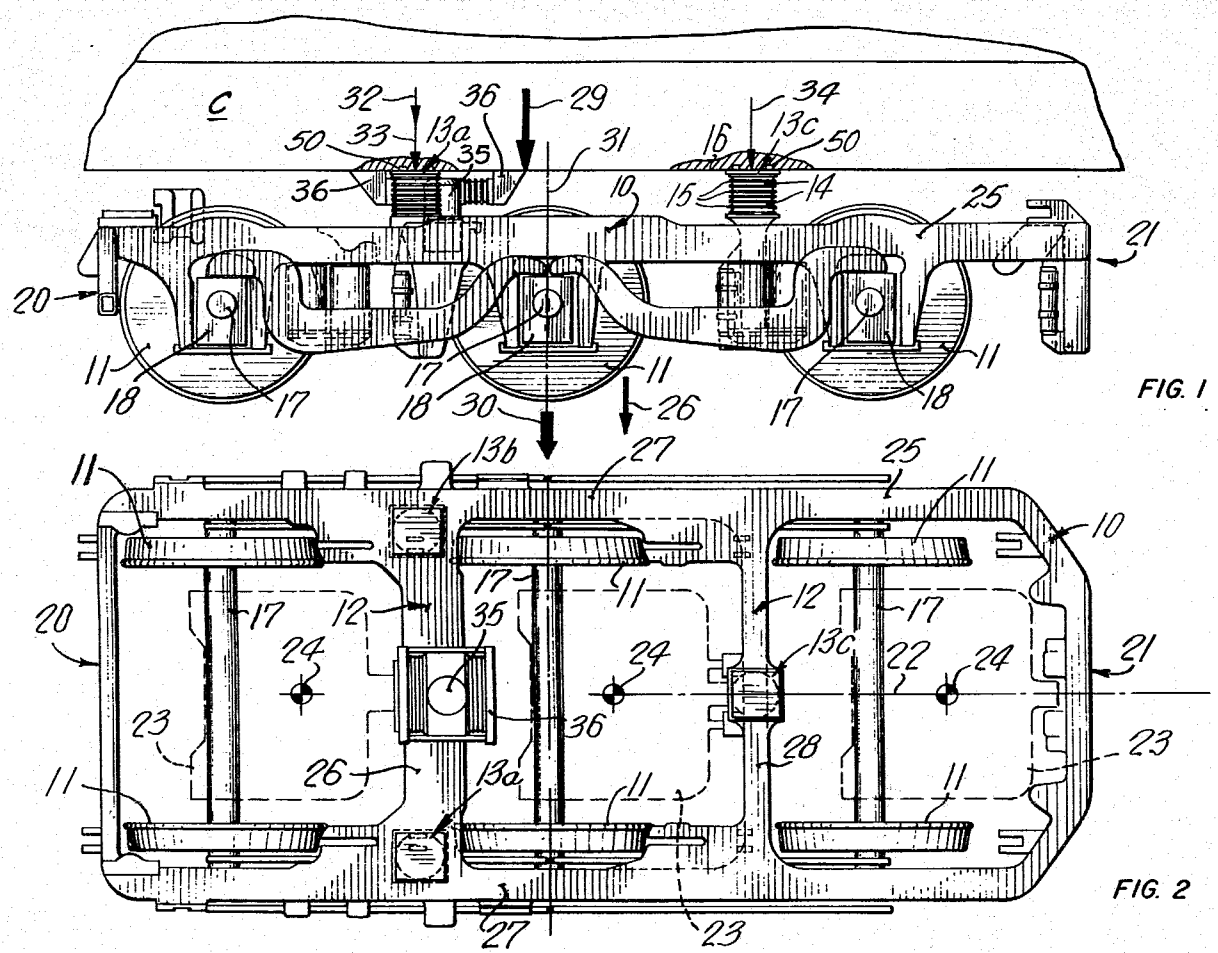
FIG. 1 is a side view of a three-axle truck chassis including the secondary suspension of the present invention in relation to a fragmentary portion of a car body chassis.
FIG. 2 is a top view of a fragmented portion of the three-axle truck chassis.

Referring now to the drawings, there is shown a three-axle truck frame 10 having an outboard end 20 and an inboard end 21. The truck frame is supported by three sets of flanged wheels 11 each having an axle 17 connected at its ends in respective journal boxes 18. On the upper surface 12 of the truck frame 10 there is secured three laminated pads **13*a*, 13*b* and 13*c*. These pads are formed of laminated rubber and metal plates, 14 and 15, respectively. The laminated pads are arranged with two of these pads 13*a* and 13*b* located on respective side of the truck frame 10, and in alignment, at approximately one third the distance from the outboard end 20 of the truck frame 10. The other pad 13*c* is positioned on the central longitudinal axis 22 of the truck frame 10 at approximately one third the distance from the inboard end of the truck frame. The three pads are cylindrical and of circular cross-section and arranged whereby the load at one end of carbody chassis a lower surface 16 thereof resting on the pads 13*a*, 13*b* and 13*c* is distributed approximately equally amongst the pads. The pads have bosses 50 on upper plates, the bosses 50 being located in respective openings in the lower surface 16** of the chassis. In order that the operating characteristics of the pads are the same, three identical pads can be used.

Referring to FIG. 2 there is shown the disposition of the traction motors 23 which are mounted on bearings on each axle 17 and additionally supported by the truck frame. The center of gravity 24 of the motors 23 disposed toward the inboard end 21 of the truck and the mass of the casting 25 because of its non-symmetry is also disposed inboard of the center axle thus giving a resultant force that will act inboard of the center axle 17 on the truck, as indicated by arrow 26. However, proper locomotive design requires that the rail load from all three axles 17 be substantially equal and this implies that the resultant of the rail loads for equal axle spacing must be exactly at the center axle. The only way to balance a truck at this point is to apply the chassis load so that its resultant force is forward of the center axle of the truck or toward the outboard end 20 of the truck. Mechanical considerations in the casting make it desirable to apply the pads substantially as shown in the figures, that is, with the two pads 13*a* and 13*b* near the juncture of a transom 26 and the side rails 27 and obviously the single third pad can only go on some transom of the truck. For the dimensions now existing of motors and wheel sets, when a truck is designed, it works out rather conveniently that the two pads are not very far forward of the central axle and wheel set. However, because the motor hangs toward the inboard end 21 of the truck, the first place that a transom can be designed across is substantially further away from the center axle than the aforementioned transom. This other transom is shown at 28. This fortuitous arrangement of transoms makes it desirable to lay out the pads and take advantage of their naturally occurring favorable location. That is, two pads somewhat forward of the axle, one pad on the transom 28 behind the central axle. The resultant applied chassis load, arrow 29, which favours the two pads is forward of the central axle by some slight distance that can be figured exactly, whereby the resultant force 29 will balance the resultant force of the truck sprung masses 26, which is rearward of the central axle, thereby giving a net resultant rail force 30 substantially at said central axle in the vertical plane 31.

It is a well known property of the laminated pads 13, that when sufficient load is applied perpendicular to the plane of the layers, the force required to displace one end relative to the other parallel to the layers, can be made to be substantially zero, or less than zero if desired (i.e. unstable).

The above described secondary suspension accommodates truck rotation as well as lateral motion. On a three-axle truck to achieve proper control of weight transfer, particularly when all the motors 23 are facing the same direction from the axles, the truck frame 10 should be held as firmly as possible parallel to the carbody chassis and yet at the same time be as free to pivot about the vertical axis as possible. It is very important that the torsional stiffness of the secondary suspension be reduced to as close to zero as practical.

It should be noted that this design of truck requires two trucks for locomotive and that where the terms outboard and inboard have been used, this arrangement is not mandatory and it is entirely possible that the entire truck as shown in the figures could be reapplied under a new locomotive design to apply the motor noses outboard in both trucks. Further, it is even conceivable that a locomotive chassis could be laid out with the two trucks in a manner that all of the motor noses are nominally forward with respect to the locomotive or nominally rearward with respect to the locomotive. The analysis of the load applied to the pad versus the load resulting from the non-symmetry of the trucks remains identical.

Further, concerning the shape of the pads these can be shaped in such a manner that different shear rates will obtain in different directions for a given perpendicular load. For example an oblong pad will be much stiffer when sheared in the direction of the long axis than in the direction of the short axis. Rubber manufacturers have clearly shown that the most favourable shear rates can be obtained from a circular pad which is one that allows the highest unit loading and therefore can achieve lowest shear rate. Because of the basic symmetry of the shape of circular pads the shear rate is equal in all directions. The use of circular pads in the present invention permits the smallest area of rubber to be used in the design of the pad to raise the unit loading on the rubber as high as possible and therefore to secure lowest possible shear rate particularly as related to rotation of the truck. It is recognized in many other patents that a lateral connection is also necessary between the truck frame and chassis and that this rate should not be substantially zero but some definable value. The present invention accommodates this by recognizing that when the shear rate of the support pads is reduced close to zero, they contribute no lateral restoring force on the truck; therefore, the rubber pads arranged around the center pin 35 of the truck which take the tractive loads are also designed to provide the proper restoring force laterally on the truck. These pads do not contribute in any way to torsional resistance of the truck because they are not required to shear when the truck rotates. In other words, the truck rotates substantially about the pin 35 on the truck which engages the rubber supported block 36 on the chassis.

We claim:

1. A locomotive truck including a secondary suspension for use on a railway three-axle truck frame, each of said three axles being equidistantly spaced from one another and being driven by a respective traction motor mounted on bearings on each axle and additionally supported by said truck frame, said secondary suspension comprising three identical laminated metal and rubber pads of cylindrical shape and circular cross-section positioned between the upper surface of said truck frame and said locomotive chassis, the laminated pads each having substantially zero shear rate horizontally in all directions when subjected to a vertical load by the mass of one end of the locomotive chassis supported thereby two of said pads being positioned forwardly of the central axle of said three axles and to a respective side of the central longitudinal axis of said truck frame, the other pad being positioned on said central longitudinal axis rearwardly of said central axle, said spacing of said pads relative to said central axle being predetermined to apply a resultant force of the mass of one end of said locomotive chassis forwardly of the central axle with all three pads equally loaded by said one end of the locomotive chassis whereby said resultant force will balance the resultant force of the truck sprung masses which is rearwardly of said central axle thereby giving a net resultant rail force substantially at said central axle, approximately two-thirds of the mass of one end of the locomotive chassis being supported on said two pads positioned forwardly of the central axle, said two pads being located approximately one-third the distance from an outboard end of the truck frame, and approximately one-third of the mass of the one end of the locomotive chassis being supported on said other pad positioned rearwardly of the central axle and approximately one-third the distance from an inboard end of the truck frame, the truck frame having a centre pin extending upwardly therefrom to engage the locomotive chassis to provide a traction connection therebetween, said centre pin being located on the truck between the two laminated pads and in longitudinally-spaced relation from the central axle; the centre pin engaging a pair of elastic pads mounted in a support block situated on a lower surface of the locomotive chassis, the two elastic pads extending horizontally between the centre pin and the support block and being positioned so as to transmit the traction forces and provide a lateral restoring force to the locomotive chassis.

* * * * *